US008449697B2

(12) United States Patent
Sahu et al.

(10) Patent No.: US 8,449,697 B2
(45) Date of Patent: May 28, 2013

(54) WEAR AND CORROSION RESISTANT CU—NI ALLOY

(76) Inventors: Sudhari Sahu, Glendale, WI (US); Alpana Pradipkumar Sahu, Matteson, IL (US)

( * ) Notice: Subject to any disclaimer, the term of this patent is extended or adjusted under 35 U.S.C. 154(b) by 103 days.

(21) Appl. No.: 13/035,970

(22) Filed: Feb. 27, 2011

(65) Prior Publication Data

US 2011/0226138 A1 Sep. 22, 2011

Related U.S. Application Data

(60) Provisional application No. 61/314,562, filed on Mar. 16, 2010.

(51) Int. Cl.
*C22C 9/06* (2006.01)

(52) U.S. Cl.
USPC ..... 148/435; 148/433; 420/473; 420/487

(58) Field of Classification Search
USPC ..... 420/487, 473; 148/433, 435
See application file for complete search history.

(56) References Cited

U.S. PATENT DOCUMENTS

| | | | | |
|---|---|---|---|---|
| 1,872,280 | A * | 8/1932 | Halliwell | 148/677 |
| 3,956,027 | A * | 5/1976 | Parikh et al. | 148/684 |
| 4,879,094 | A | 11/1989 | Rushton | |
| 5,167,726 | A | 12/1992 | LoIocano | |
| 5,242,657 | A | 9/1993 | Sahu | |
| 5,330,712 | A | 7/1994 | Singh | |
| 5,413,756 | A | 5/1995 | Sahu | |
| 5,487,867 | A | 1/1996 | Singh | |
| 5,614,038 | A | 3/1997 | King | |
| 5,846,483 | A | 12/1998 | Sahu | |
| 6,059,901 | A | 5/2000 | Sahu | |
| 6,149,739 | A | 11/2000 | Smith | |

FOREIGN PATENT DOCUMENTS

DE 1205285 B * 11/1965

* cited by examiner

*Primary Examiner* — Sikyin Ip
(74) *Attorney, Agent, or Firm* — Pradip K. Sahu

(57) ABSTRACT

A silicon bearing, copper-nickel corrosion resistant and gall resistant alloy with the following weight percentage range is disclosed: Ni=10-40; Fe=1-10; Si=0.5-2.5; Mn=3-15; Sn=0-3; Cu=Balance. Embodiments of the alloy may be used in various sliding applications, such as bearings, bushings, gears and guides. The alloy is particularly suited for use in parts used in food processing equipment.

2 Claims, 2 Drawing Sheets

WEAR AND CORROSION RESISTANT CU—NI ALLOY

CLAIM FOR PRIORITY

This application claims priority from U.S. Provisional Patent Application Ser. No. 61/314,562 filed on Mar. 16, 2010.

BACKGROUND OF THE INVENTION

This invention relates to Si bearing, corrosion resistant Cu—Ni alloys that are especially suited for use in food processing equipment. The alloys can also be used in other sliding metal applications in the form of bearings, bushings, blades, gears, guides, slides, vanes, impellers and other components. This highly wear resistant alloy may be continuously or statically cast, and it may be mechanically treated into different shapes. The alloy may be described as a silicized dairy metal.

Prior to 1990, lead containing Cu—Ni—Sn—Zn alloys popularly known as "Dairy Metals" were used in food processing machines. Other names for these metals are "Dairy Bronze", "German Silver" and "Nickel Silver." Health concerns regarding Pb led to its replacement by Bi and/or Se. Many Cu-base alloys (See, for example, Rushton, U.S. Pat. No. 4,879,094; Lolocano et. al., U.S. Pat. No. 5,167,726; Sahu, U.S. Pat. No. 5,242,657; Singh, U.S. Pat. No. 5,330,712; Sahu, U.S. Pat. No. 5,413,756; Singh, U.S. Pat. No. 5,487,867; King et. al., U.S. Pat. No. 5,614,038; Sahu, U.S. Pat. No. 5,846,483; Sahu, U.S. Pat. No. 6,059,901; and Smith, U.S. Pat. No. 6,149,739).

Some of these alloys (such as, for example, Sahu, U.S. Pat. Nos. 5,242,657; Sahu U.S. Pat. No. 5,846,483; Sahu, U.S. Pat. No. 6,059,901; and Smith, U.S. Pat. No. 6,149,379) are used in contact with comestibles in food forming equipment. Sometimes aluminum bronzes like C954 are also used. However, these alloys are relatively soft and wear out quickly. Aluminum bronzes have poor corrosion resistance and turn green during use, so they should not be used in contact with food. The following Table 1 lists properties of alloys disclosed in the aforementioned patents as well as bronze C954. Properties disclosed are well known in the art and include tensile strength measured in KSI, yield strength measured in KSI, percent elongation, and hardness measured in BHN (Brinnel hardness number).

TABLE 1

Hardness and Mechanical Properties of Certain Dairy Metals and Al Bronze (C954)

| | Dairy Metals Covered by Different U.S. Patents | | | | Al Bronze |
|---|---|---|---|---|---|
| | U.S. Pat. No. 5,242,657 | U.S. Pat. No. 5,846,483 | U.S. Pat. No. 6,059,901 | U.S. Pat. No. 6,149,379 | C954 (CDA Data) |
| Tensile Strength (KSI) | 20-30 | 40-55 | 42-58 | 55 | 75 |
| Yield Strength (KSI) | 18-28 | 28-35 | 34-45 | 30 | 30 |
| % Elongation (in 2 inches) | 0.5-3.0 | 5-10 | 3-8 | 13 | 12 |
| Hardness (BHN) | 110-140 | 110-155 | 110-140 | 130 | 170 |

Therefore, a goal of certain preferred embodiments of this invention is to provide a moderate cost alloy with higher hardness and wear resistance that maintains good corrosion and anti-galling characteristics coupled with high strength and good ductility.

SUMMARY OF THE INVENTION

A preferred composition of our alloy is as follows:

| Element | Weight Percent |
|---|---|
| Nickel | 20 |
| Iron | 2.5 |
| Silicon | 1.4 |
| Manganese | 5 |
| Copper | Balance |

Variation in the above chemistry is possible, and a satisfactory alloy can have the following chemical ranges.

| Element | Weight Percent |
|---|---|
| Nickel | 10-40 |
| Iron | 1-10 |
| Silicon | 0.5-2.5 |
| Manganese | 3-15 |
| Tin | 0-3 |
| Copper | Balance, substantially |

The alloy may contain small amounts of C, Ti, Al, Zn and other elements as incidental or trace amounts. When the ingredients are mixed in approximately the preferred composition, the following physical properties are obtained.

| Properties | |
|---|---|
| Tensile Strength (KSI) | 70-110 |
| Yield Strength (KSI) | 55-95 |
| % Elongation (in 2 inches) | 3-15 |
| Hardness (BHN) | 170-250 |

DETAILED DESCRIPTION OF PREFERRED EMBODIMENTS

Figure 1:
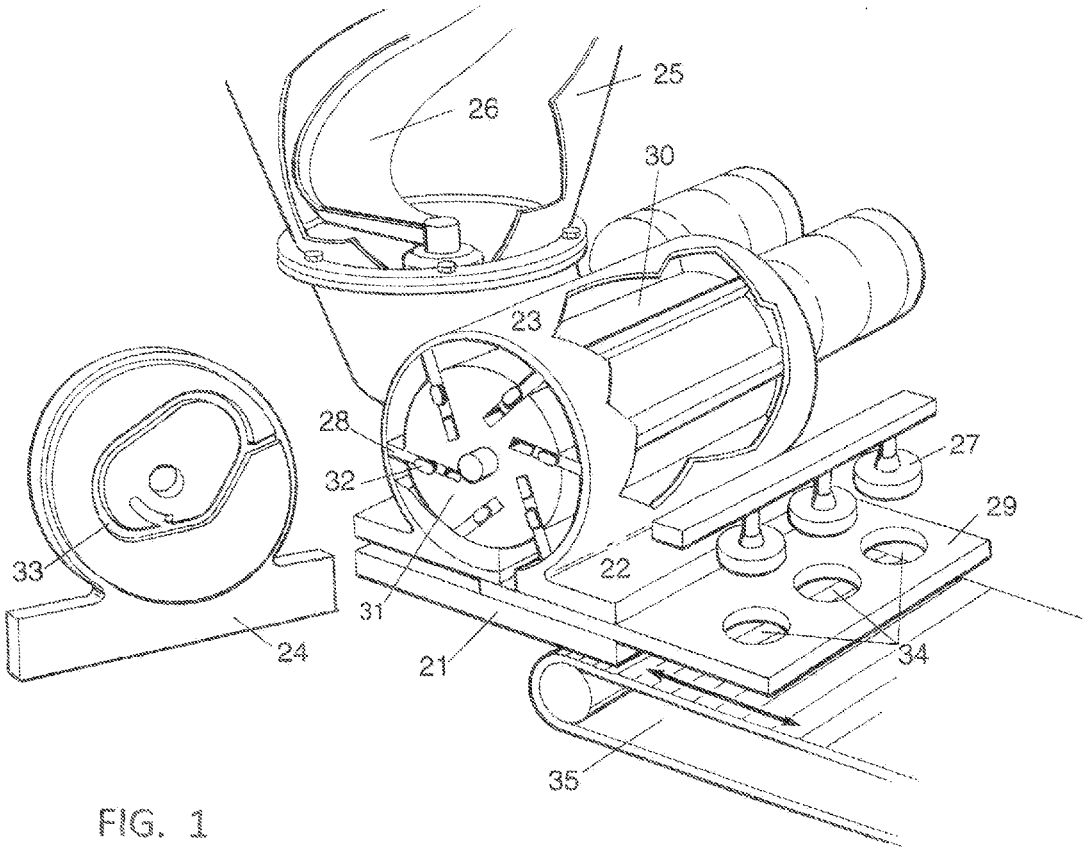
FIG. 1 shows a portion of a food forming machine in which parts made with the alloy of the present invention may be embodied.

The alloy of the present invention can be melted in a gas fired crucible or in an electric induction furnace using processes known in the art. Nickel may be charged at the bottom of the melting vessel followed by copper. Melting can be started at high power. When the charge becomes partially molten, manganese can be gradually added, which melts readily. When the charge becomes completely molten, copper-iron and pure silicon can be added. After a few minutes, a preliminary analysis of the melt can be conducted. Adjustment in chemistry can be made at this point. The melt can then be deoxidized with a deoxidizing agent and slagged off. The molten alloy or "heat" can then be tapped into a pouring ladle and subsequently poured into molds to cast parts of desired shapes and sizes. The following Tables 2 and 3 list chemistries and mechanical properties, respectively, of five heats of the alloy of the present invention made using the process just outlined.

TABLE 2

Chemistry of Silicized Dairy Metal Samples Tested

| | Element (Percent by Weight) | | | | |
|---|---|---|---|---|---|
| Alloy ID | Cu | Ni | Fe | Si | Mn |
| 29B | Balance | 19.94 | 3.00 | 1.36 | 5.10 |
| 38A | Balance | 19.59 | 2.92 | 1.45 | 4.91 |
| 50A | Balance | 20.58 | 2.03 | 1.54 | 5.25 |
| 91B | Balance | 20.58 | 2.71 | 1.44 | 4.60 |
| 94C | Balance | 20.37 | 2.92 | 1.49 | 4.92 |

TABLE 3

Mechanical Properties of Silicized Dairy Metal Samples Tested

| Alloy ID | Tensile Strength (KSI) | Yield Strength (KSI) | % Elongation (in 2 inches) | Hardness (BHN) |
|---|---|---|---|---|
| 29B | 97.7 | 94.6 | 6.0 | 229 |
| 38A | 93.0 | 91.5 | 6.4 | 222 |
| 50A | 81.1 | 72.8 | 12.1 | 197 |
| 91B | 77.8 | 76.2 | 3.5 | 250 |
| 94C | 106.5 | 69.0 | 14.0 | 234 |

A comparison of mechanical properties of the present alloys as listed in Table 3 with those of previous inventions as listed in Table 1 makes it very clear that the present alloy unexpectedly has approximately twice the tensile strength and 2.5 times the yield strength of the previous inventions. Additionally, hardness of the present alloy is unexpectedly 70-100 BHN higher than the previous alloys. Because of its surprisingly higher strength and hardness, the present alloy gives 3-12 times longer life compared to previous alloys depending on the application.

Corrosion Resistance

Alloys used in applications in which they come in contact with food products must have adequate corrosion resistance to chemicals in the food as well as in the cleaning and sanitizing compounds. Poor corrosion resistance will lead to product contamination as well as difficulties in sanitizing and possible bacterial growth.

The following corrosive compounds were selected to run the corrosion tests:

1. Five weight percent of sodium hydroxide in water.
2. SteraSheen™: This is a cleaning and sanitizing formula sold by Purdy Products Company of Wauconda, Ill. One ounce of Stera-Sheen™ powder was mixed with one gallon of water. This solution had 100 ppm available chlorine.
3. Cloverleaf™ CLF-3300: This is a concentrated cleaning compound marketed by Cloverleaf Chemical Company of Bourbonnais, Ill. The solution was prepared by mixing one ounce of this cleanser with one gallon of water. This solution had 220 ppm chlorine ion in it.

The corrosion test was run per ASTM Specification G31-72. The specimens tested were from sample Alloy ID 50A, and was in the form of a disc with nominal OD=1.250", ID=0.375" and thickness=0.187". Properly prepared specimens were weighed and their dimensions measured. Each sample was put inside a one liter solution of each of the above compounds. The solutions were kept at 150° F. and magnetically stirred. The specimens were kept in solution for 72 hours. At the end of this period the specimens were taken out, washed, dried and re-weighed. From the weight difference and the dimensions of each specimen, the corrosion rate in mils per year was computed. Two specimens were tested for each condition and the averages of two readings are reported in Table 4.

TABLE 4

Corrosion Rate in Mils Per Year

| | Corrosive Agent: | | |
|---|---|---|---|
| | NaOH | Stera-Sheen ™ | Cloverleaf ™ CLF-3300 |
| Corrosion Rate: (mils per year) | 2.15 | 3.20 | 3.15 |

In general, a corrosion rate of 10 mils per year or less is considered perfectly acceptable. On this basis, the present alloy has very good corrosion resistance and comparable to the alloy of U.S. Pat. No. 5,846,483.

Typical Applications in Equipment

Figure 2:
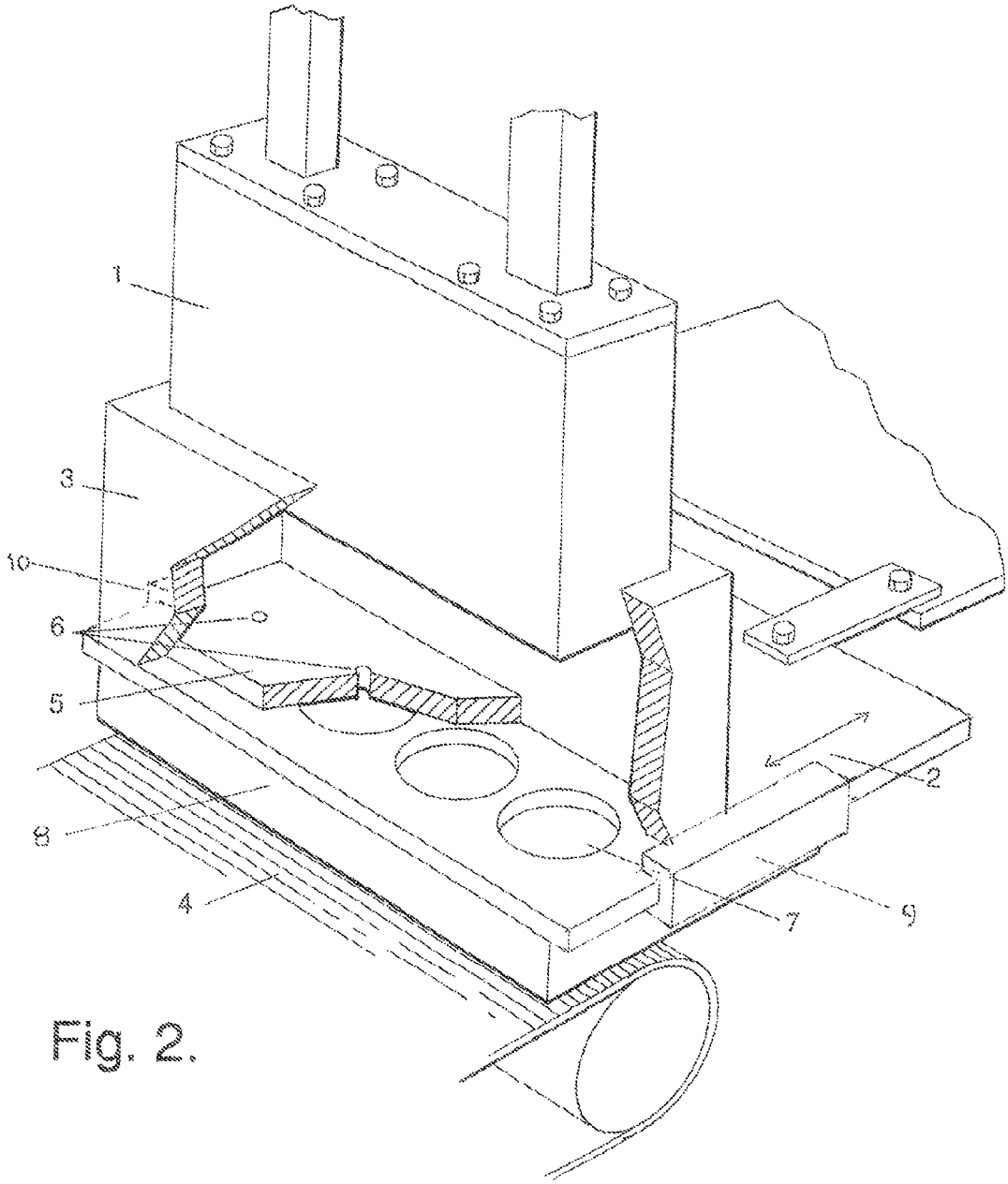
FIG. 2 shows a portion of another piece of food forming equipment in which parts made with the alloy of this invention may be embodied.

Two typical pieces of equipment in which the present alloy may be incorporated are shown in FIG. 1 and FIG. 2. FIG. 1 shows a portion of a food shaping machine known in the art. The bottom plate 21, top plate 22, pump housing 23, cover plate 24, hopper 25, spiral 26 and knock-out punch 27 may be made out of stainless steel, either cast or wrought. The pump vanes 28 and the mold plate 29 may be made out of the present alloy, either statically cast or continuously cast. During operation, intermittent rotation of the spiral 26 gently pushes the product into vane style pump 30. The product is then conveyed by the rotor 31 until the leading vane 28 is retracted. This is accomplished by blade end guide 32 following the guide groove 33 in the end plate 24. Once the vane 28 is retracted, the product under pressure flows into the mold plate cavities 34 at the appropriate time. The mold plate 29 is then moved out to knock-out position at which time the food portion is knocked out onto a conveyer belt 35 by the knock-out punch 27. The mold plate 29 then retracts into original position and the process repeats again. In experimental field trials, pump vanes 28 made of the alloy of the current invention surprisingly outlasted those made from the old alloy by a factor of 3-5, exceeding all expectations.

FIG. 2 depicts part of a different food forming machine known in the art. Chamber 3, base plate 5 and plate support 8 may be made from standard cast or wrought stainless steel. Plunger 1, plate 2 (in contact with food) and shuttle bearings 9, 10 may be made from the present alloy. The opposed members 3 and 5 can also be made of the present alloy. Other parts in contact with food may also be made from the present alloy. In operation, the food product charged into the valve chamber 3 is pushed under pressure by plunger 1 into die cavities 7 through inlet openings 6 in the base plate 5. The plunger 1 then retracts. The plate 5 is pushed forward (to the left as shown in FIG. 2) and portions are knocked out onto the conveyer 4. The shuttle bearings 9, 10 guide the plate 2 during reciprocating motion. The plate 2 then moves back into the original position, and the whole process repeats again. In experimental field trials, shuttle bearings 9, 10 made of the alloy of the current invention surprisingly outlasted those made from the old alloy by a factor of 8-12, exceeding all expectations.

We claim:

1. A silicon bearing copper-nickel, corrosion resistant, wear resistant and anti-galling cast alloy, consisting essentially of, in weight percentage:

Ni=20
Fe=2.5
Si=1.4
Mn=5
Cu=Balance.

2. An alloy consisting essentially of, in weight percentage:

Ni=about 20
Fe=about 2.5
Si=about 1.4
Mn=about 5
Cu=Balance.

* * * * *